US006869106B2

(12) United States Patent
Palmiri et al.

(10) Patent No.: US 6,869,106 B2
(45) Date of Patent: Mar. 22, 2005

(54) BLOCK MANIFOLD FOR HEAT EXCHANGER BATTERY FAN COILS

(75) Inventors: Ermiro A. Palmiri, Sarezzo (IT); Alan Gilberti, Castegnato (IT)

(73) Assignee: Tiemme Raccorderie S.p.A., Castegnato (IT)

( * ) Notice: Subject to any disclaimer, the term of this patent is extended or adjusted under 35 U.S.C. 154(b) by 0 days.

(21) Appl. No.: 10/196,699

(22) Filed: Jul. 16, 2002

(65) Prior Publication Data

US 2003/0020277 A1 Jan. 30, 2003

Related U.S. Application Data

(63) Continuation-in-part of application No. 09/619,258, filed on Jul. 19, 2000, now abandoned.

(30) Foreign Application Priority Data

Jul. 19, 1999 (IT) ..... BS99000076 U

(51) Int. Cl.[7] ..... F16L 51/00

(52) U.S. Cl. ..... 285/125.1; 285/120.1; 285/122.1; 165/173

(58) Field of Search ..... 285/125.1, 122.1, 285/120.1; 165/173, 175

(56) References Cited

U.S. PATENT DOCUMENTS

| | | | | |
|---|---|---|---|---|
| 1,092,385 A | | 4/1914 | Parker | |
| 1,160,839 A | | 11/1915 | Butts | |
| 1,205,508 A | | 11/1916 | Bodell | |
| 2,673,101 A | | 3/1954 | Maslin | |
| 3,611,553 A | * | 10/1971 | Lightbody | 29/558 |
| 3,790,966 A | * | 2/1974 | Keane | 4/676 |
| 3,951,440 A | | 4/1976 | Dolder | |
| 4,013,049 A | * | 3/1977 | Dilgard et al. | 123/184.39 |
| 4,541,448 A | * | 9/1985 | Kolze | 137/62 |
| 5,078,432 A | | 1/1992 | Seiter | |
| 5,143,151 A | | 9/1992 | Pain | |
| 5,176,177 A | | 1/1993 | Rupp | |
| 5,908,288 A | | 6/1999 | Moran | |
| 6,202,686 B1 | * | 3/2001 | Pitsch et al. | 137/597 |
| 6,237,408 B1 | * | 5/2001 | McCormick | 73/196 |

FOREIGN PATENT DOCUMENTS

| | | |
|---|---|---|
| GB | 10174 | 7/1914 |
| GB | 897965 | 6/1962 |

* cited by examiner

*Primary Examiner*—Carlos Lugo
(74) *Attorney, Agent, or Firm*—McGlew and Tuttle, P.C.

(57) ABSTRACT

A block body (11) has a fitting (12) with a fluid pipe for connection to a heat exchanger battery, two three or more branches (13) for connection to the pipes of the heat exchanger battery and an intermediate distribution chamber (14) to connect the fitting (12) with the branches (13). This intermediate chamber (14) is circular, completely closed all round and is coaxial with the union part or fitting (12).

6 Claims, 2 Drawing Sheets

BLOCK MANIFOLD FOR HEAT EXCHANGER BATTERY FAN COILS

This is a Continuation In Part of application Ser. No. 09/619,258 filed Jul. 19, 2000 now abandoned, and the entire disclosure of this prior application is considered to be part of the disclosure of the accompanying application and is hereby incorporated by reference therein.

FIELD OF THE INVENTION

This invention concerns a block manifold for fitting to heat exchanger batteries and especially for fan coils (fan cooled cooling coils).

BACKGROUND OF THE INVENTION

In fan coils the heat exchanger batteries have fluid circulation pipes, the ends of which are connected to manifolds through which the fluid flows and return pipes are connected. Usually the manifolds have a block body with a part fitting to fluid piping, two, three or more branches for connection to the battery pipes and a distribution chamber between the fitting and the branches. Generally, this block body is cylindrical and its geometric axis is oriented transversely to the axes of the fittings and the branches which are substantially parallel to each other.

By its presence and conformation, this chamber is already a cause of turbulence in the fluid and a loss of pressure in the system and contributes to pointlessly increasing the external dimensions of the manifold.

Moreover, due to the shape of, and machining requirements inside the body of this intermediate cylindrical chamber, it is left open at one end and is only closed, with a plug that is generally welded on at the end. This plug represents a critical part of the manifold.

At the same time, inserting and fixing this plug requires additional production work time and costs. Furthermore, if the welding is not homogenous it becomes a source of rejection, because in this case the manifold cannot be used.

SUMMARY AND OBJECTS OF THE INVENTION

Starting from this introduction, the purpose of this invention is to create and supply a manifold for heat exchanger batteries which is new and original in conformation, capable of providing diverse advantages over manifolds of known technical merit in construction, economical and functional terms.

Material stock is pre-formed to define the general shape of the block body by forging, while the stock material is in a plastic state, which is generally at elevated temperatures. The material stock is generally in the form of an extruded product, which may be sectioned into blanks before the desired general shape is forged. In addition to forging of material stock, injection molding, die casting, pressure die casting and other similar methods can be used to form the block body, also with satisfactory results relating to speed, economy, quality and minimization of wasted material.

This aim has been reached by a manifold for the use cited above which includes a block body, here housing the distribution chamber located between the integral fitting and integral branch parts, and which is coaxial to the fitting and on a parallel axis to the branches.

In other words, all of the element axes of the manifold are oriented in parallel to each other. This parallel orientation allows a reduction in the external dimensions of the body, while maintaining the technical characteristics required for its use and a reduction in the raw materials used to make it. The process of the present invention can produce block body outer dimensions which are less than 145% of the aggregate diameter (general diameter not considerate of variances such as the inclusion of branch bores) of the distribution chamber, this feature is important where space is limited as in close quarters applications. Furthermore, all steps involved in the internal machining of the body to provide communication (fluid flow) between the integral fitting and the integral branches can be performed with machining operations utilizing axes of motion which are all parallel to the axis of the distribution chamber. Machining operations used to form the distribution chamber can be performed by accessing the distribution chamber through the fitting opening without the need for lateral access openings. Likewise, the boring of passages in the branches is accomplished from the side of the block body opposite the fitting. The insertion and welding of a plug is thus eliminated and consequently also the risk of rejects and some production costs. A distribution chamber with a diameter that is larger than the diameter of the opening in the fitting is also achievable through the formation of an undercut in the block body below the fitting opening. Also, and not least, the distribution chamber with its axis parallel to the integral fitting and the integral branches contributes to reducing if not completely eliminating, the turbulence in the fluid and the pressure losses in the supplied system.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
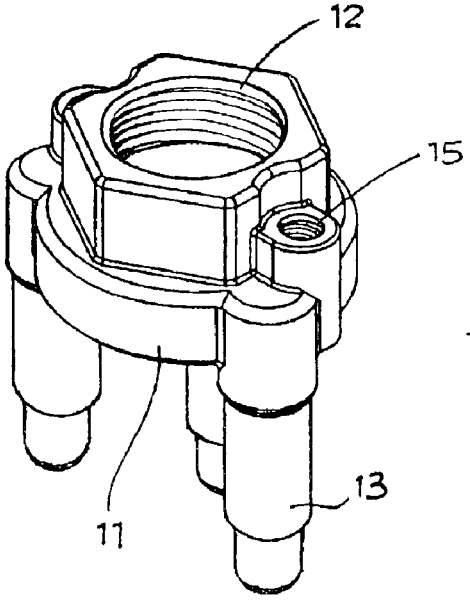
FIG. 1 shows a perspective view.
Figure 2:
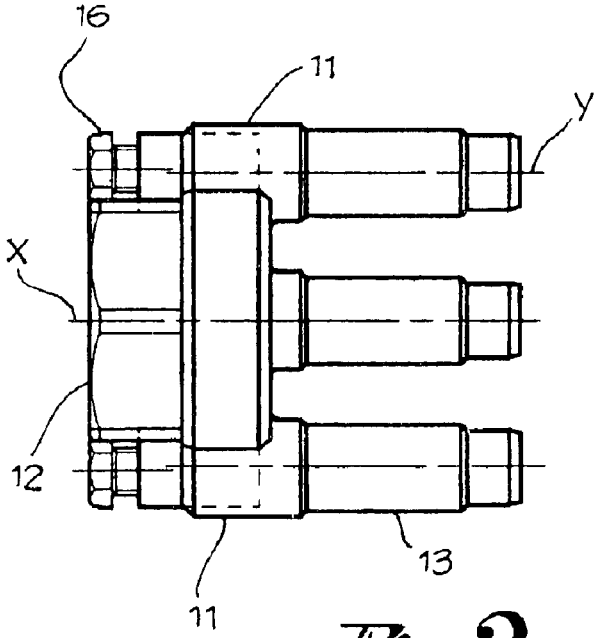
FIG. 2 shows a side view.
Figure 3:
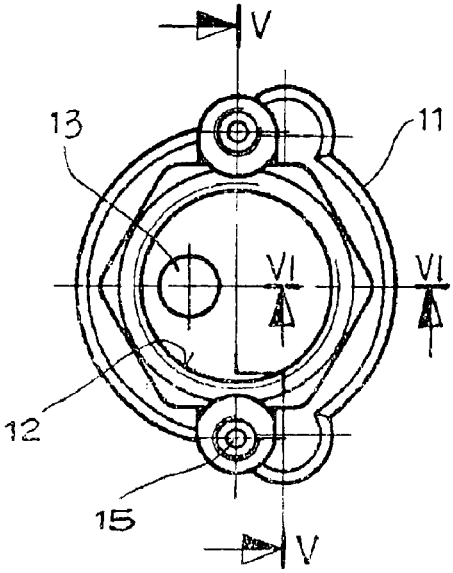
FIG. 3 shows an end view of the fitting side.
Figure 4:
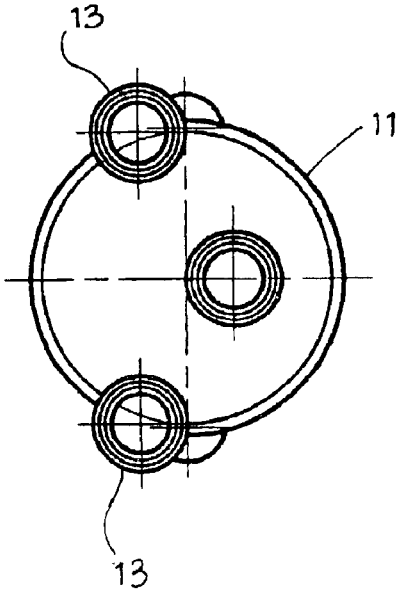
FIG. 4 shows a side view of the branches.
Figure 5:
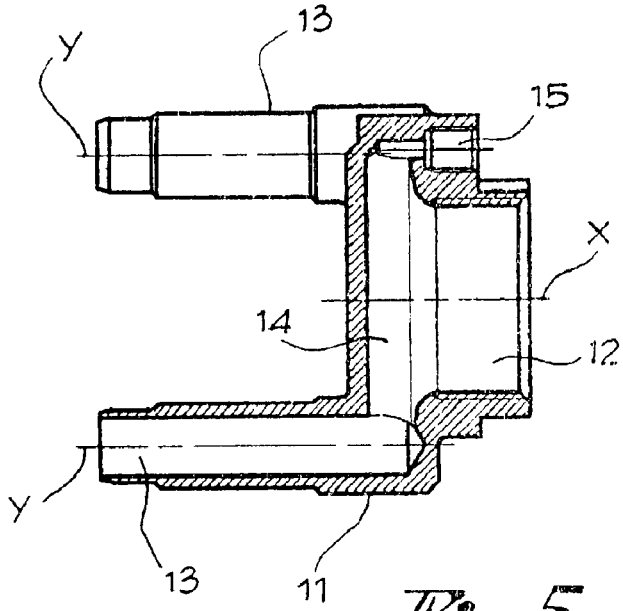
FIG. 5 shows a section according to the V—V arrows in FIG. 3.
Figure 6:
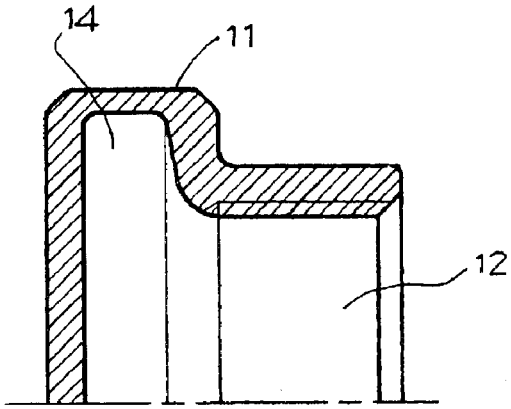
FIG. 6 shows a cross-section of a part of the body according to the VI—VI arrows in FIG. 3.

Referring to the drawings, the manifold is comprised of a block body 11, made of brass. The resulting body 11 is obtained with normal forming techniques beginning with extrusion forming brass stock. The brass stock is then sectioned and forged into the general shape of the block body 11. In order to facilitate forging of the stock, the stock is heated to a plastic state, in which it is highly formable, and susceptibility to fracture and cracking is reduced when compared to un-heated stock. Machining process are then performed to finish/form the distribution chamber 14, integral fitting 12, integral seats 15 and bores of the integral branches 13. The machining steps are all performed utilizing rotary tooling operating about axes which are parallel to the axis of the distribution chamber 14, and turning operations which are also parallel to the axis of the distribution chamber 14. The distribution chamber 14 is formed with a larger diameter than the effective hole diameter of the fitting 12. This is accomplished by forming an undercut beneath the opening of the fitting 12. The diameter of the distribution chamber 14 which is larger than the hole diameter of the fitting 12 facilitates the communication (fluid connection) between an inlet pipe connected to the integral fitting 12 and fluid circulation pipes connected to the integral branches 13. This is especially important when there is little or no projected area in common between the bores of the inlet pipe and the fluid circulation pipes.

It is anyway evident that all the machining on the body and especially on the intermediate chamber can be performed on the same line or in parallel to the axis of the fitting, thus greatly simplifying the machining process.

The branches 13 have a substantially circular outer form. This outer form when combined with the bore through the branch forms essentially a fluid pipe. The branches 13 have a stepped or tapered diameter that is smaller at a distal end of the branches, the distal end being at the tip of the branch away from the distribution chamber. The stepped diameter facilitates the reduction in the amount of raw material used, while providing adequate strength where needed to prevent bending or breaking of the branches.

A wrench engaging surface consisting of a hex drive is formed around the integral fitting 12. This surface facilitated the use of an installation tool such as a wrench for turning, or holding from turning, as the manifold is assembled to the piping.

The block body is formed such that an outer aggregate diameter of the block body when measured as a diameter about the axis of the distribution chamber 14, is not more than 145% of the aggregate diameter of the distribution chamber. This is accomplished through the design of the undercut formed during the machining of the distribution chamber and or the location of the integral branches 13. The outer aggregate diameter of the block body about an aggregate diameter of the distribution chamber is not more than 145% of the aggregate diameter of the distribution chamber.

The block body 11, when finished, has an integrally formed fitting 12 with an internal thread on one end, and two, three or more integrally formed branches 13 on the opposite end.

The fitting 12 has a geometric axis X. The branches 13 have Y axes parallel to the X axis of the union part or fitting 12.

As regards the internal chamber 14, this is circular and completely closed all round, coaxial with the integral fitting 12 and with a radius broad enough to intersect the branches. All this to achieve the purpose and advantages described above.

In the body, on the sides of the integral fitting 12, seats 15 for plug pins or fasteners 16 have been made. These are utilized to physically mount the block body 11 to a stationary bracket or other secure structure.

While specific embodiments of the invention have been shown and described in detail to illustrate the application of the principles of the invention, it will be understood that the invention may be embodied otherwise without departing from such principles.

What is claimed:

1. A block manifold comprising:

a one-piece block body defining a distribution chamber with a circular cross section, said circular cross section having an axis, said block body having first and second ends on diametrically opposite axial ends of said chamber, with an integral fitting formed continuous with said block body, comprising said first end of said block body and in communication with said distribution chamber, said fitting having a circular shape substantially coaxial with said circular cross section of said chamber, a plurality of integral branches formed continuous with said block body, comprising said second end of said block body, each of said plurality of branches defining a passage having a cylindrical shape directly intersecting with one of said axial ends of said distribution chamber, said cylindrical shape of said each of said plurality of branches having a substantially straight axial axis completely parallel to said axial axis of said distribution chamber and to each other, said passage of said plurality of branches directly intersecting with an axial end of said distribution chamber which is adjacent said branches, said block body, said integral fitting and said integral branches being a homogenous and continuous single piece of brass, said integral fitting defining an opening, said distribution chamber being undercut with respect to said opening of said fitting, said branches having a substantially circular outer form with a stepped diameter that is smaller at a distal end of said branches, and a wrench interface surface about said fitting for mechanically engaging a tool.

2. A block manifold in accordance with claim 1, wherein:

said block body defines a seat on said first end; and a plug pin is arranged in said seat.

3. A block manifold in accordance with claim 2, wherein:

said block body defines another seat on said first end, said another seat being on a side of said fitting diametrically opposite said seat; and another plug pin is arranged in said another seat.

4. A block manifold in accordance with claim 3, wherein:

said seat and said another seat have an axial axis substantially parallel to said axial axis of said fitting; and said branches are located both on a circumference of said distribution chamber and within said circumference of said distribution chamber.

5. A block manifold in accordance with claim 1, wherein:

said block body, said integral fitting and said integral branches are a homogenous and continuous single piece of material.

6. A block manifold in accordance with claim 1, wherein:

an outer aggregate diameter of said block body about an aggregate diameter of said distribution chamber is not more than 145% of said aggregate diameter of said distribution chamber.

* * * * *